United States Patent [19]

Hennessy et al.

[11] 4,310,934

[45] Jan. 19, 1982

[54] WATER-CONSERVING TOILET

[76] Inventors: Arnold Hennessy, 182 Niles St., Wellington, Ontario, Canada, K0K 3L0; John D. Inch, Box 118, Lansdown, Ontario, Canada

[21] Appl. No.: 90,370

[22] Filed: Nov. 1, 1979

[51] Int. Cl.[3] ..... E03D 1/00; E03D 1/08; E03D 3/10

[52] U.S. Cl. ..... 4/321; 4/323; 4/331; 4/354; 4/362; 4/425; 4/434

[58] Field of Search ..... 4/321, 344, 335, 354, 4/323, 362, 331, 317, 328, 424, 434, 429, 421, 425, 437

[56] References Cited

U.S. PATENT DOCUMENTS

| | | | |
|---|---|---|---|
| Re. 10,826 | 4/1887 | Boyle | 4/328 |
| 372,199 | 10/1887 | Boyle | 4/424 |
| 376,002 | 1/1888 | Kennedy | 4/344 |
| 832,320 | 10/1906 | James | 4/434 X |
| 908,277 | 12/1908 | Kline et al. | 4/362 |
| 1,177,384 | 3/1916 | Cochran | 4/425 |
| 1,253,982 | 1/1918 | Kirby | 4/335 |
| 1,301,188 | 4/1919 | Stark | 4/335 |
| 1,313,060 | 8/1919 | Bresson | 4/429 |
| 1,358,841 | 11/1920 | Garvey | 4/362 |
| 1,472,259 | 10/1923 | Watrous | 4/421 |
| 1,559,956 | 11/1925 | Gunn | 4/335 |
| 1,745,387 | 2/1930 | Strehler | 4/354 X |
| 1,793,446 | 2/1931 | Oscanyan | 4/362 |
| 1,810,280 | 6/1931 | Lewis | 4/335 |
| 2,049,890 | 8/1936 | Brown | 4/335 |
| 2,164,319 | 7/1939 | Groeniger | 4/425 |
| 2,658,203 | 11/1953 | Aue | 4/332 |
| 2,918,680 | 12/1959 | Langdon | 4/362 |
| 3,029,443 | 4/1962 | Naccarato | 4/362 |
| 3,555,571 | 1/1971 | Gibbs et al. | 4/362 |
| 3,557,388 | 1/1971 | Bach | 4/323 |
| 3,568,215 | 3/1971 | Riedel et al. | 4/321 |
| 3,597,769 | 8/1971 | Brainard et al. | 4/323 |
| 3,611,447 | 10/1971 | Howard | 4/317 |
| 3,643,265 | 2/1972 | Wiswell | 4/323 |
| 3,858,249 | 1/1975 | Howard | 4/317 |
| 3,922,729 | 12/1975 | Ashley | 4/331 |
| 4,016,609 | 4/1977 | Graham | 4/437 |
| 4,222,130 | 9/1980 | Roberts | 4/321 |

*Primary Examiner*—Henry K. Artis

*Attorney, Agent, or Firm*—Rogers, Bereskin & Parr

[57] ABSTRACT

A water-conserving toilet is disclosed and includes a bowl for receiving waste and a waste outlet extending laterally from the bowl and defining a first, shallow trap arranged so that a relatively shallow body of liquid is normally retained in the bottom of the bowl for preventing gaseous flow through the trap. A flush system is provided and is arranged, when operated, to deliver a charge of flushing liquid into the bowl in a direction to cause said body of liquid to be discharged through said outlet. A waste holding tank communicates with said bowl outlet for receiving waste from the bowl and the holding tank has an outlet extending outwardly from the tank and adapted for connection to a sewer inlet. The holding tank outlet defines a second trap of substantial height capable of preventing reverse flow of sewer gas into the holding tank in use and the holding tank and second trap are arranged to contain a volume of liquid substantially in excess of the volume discharged from the bowl at each flush. A flexible diaphragm extends across the holding tank above the level at which liquid enters from the bowl and is sealed to the tank in gas-tight fashion. The diaphragm is adapted to flex upwardly and accommodate air displaced as liquid enters the tank from the bowl, so as to minimize air resistance to flushing of liquid from the bowl.

14 Claims, 15 Drawing Figures

WATER-CONSERVING TOILET

This invention relates generally to flush-type toilets.

Conventional toilets of this type are wasteful of water in that a large volume of flush-water is required for satisfactory operation. Typically, a conventional domestic toilet requires 4 or 5 gallons for each flush. Also, at least in the case of a domestic toilet a relatively large holding tank for flush water must be provided in the toilet itself; this makes for a relatively large and bulkly toilet which is difficult to make aesthetically acceptable.

Prior art attempts at reducing the volume of flush-water required have generally proved unsatisfactory for the reason that they have usually attempted to merely restrict the volume of the flush-water in the toilet tank rather than to approach the more fundamental problem of toilet design. Thus, a conventional flush toilet operates on the principle that a syphon is set up by the flush-water delivered into the toilet bowl, so that the contents of the bowl are in effect sucked out by the syphon. In order for this syphon effect to be produced it is essential that a relatively large volume of flush-water be used. In other words, the need for a large volume of flush-water is inherent in the design of a conventional toilet.

An object of the present invention is to provide an improved toilet based on novel design considerations which allow substantially smaller volumes of flush-water to be used.

The toilet provided by the invention includes a bowl for receiving waste and a waste outlet extending laterally from the bowl and defining a first, shallow trap arranged so that a relatively shallow body of liquid is normally retained in the bottom of the bowl for preventing gaseous flow through the trap. A flush system is provided and is arranged, when operated, to deliver a charge of flushing liquid into the bowl in a direction to cause said body of liquid to be discharged through said outlet. A waste holding tank communicates with said bowl outlet for receiving waste from the bowl and the holding tank has an outlet extending outwardly from the tank and adapted for connection to a sewer inlet. The holding tank outlet defines a second trap of substantial height capable of preventing reverse flow of sewer gas into the holding tank in use and the holding tank and second trap are arranged to contain a volume of liquid substantially in excess of the volume discharged from the bowl at each flush. A flexible diaphragm extends across the holding tank above the level at which liquid enters from the bowl and is sealed to the tank in gas-tight fashion. The diaphragm is adapted to flex upwardly and accommodate air displaced as liquid enters the tank from the bowl, so as to minimize air resistance to flushing of liquid from the bowl.

In order that the invention may be more clearly understood, reference will now be made to the accompanying drawings which illustrate a number of embodiments of the invention by way of example, and in which.

Figure 1:
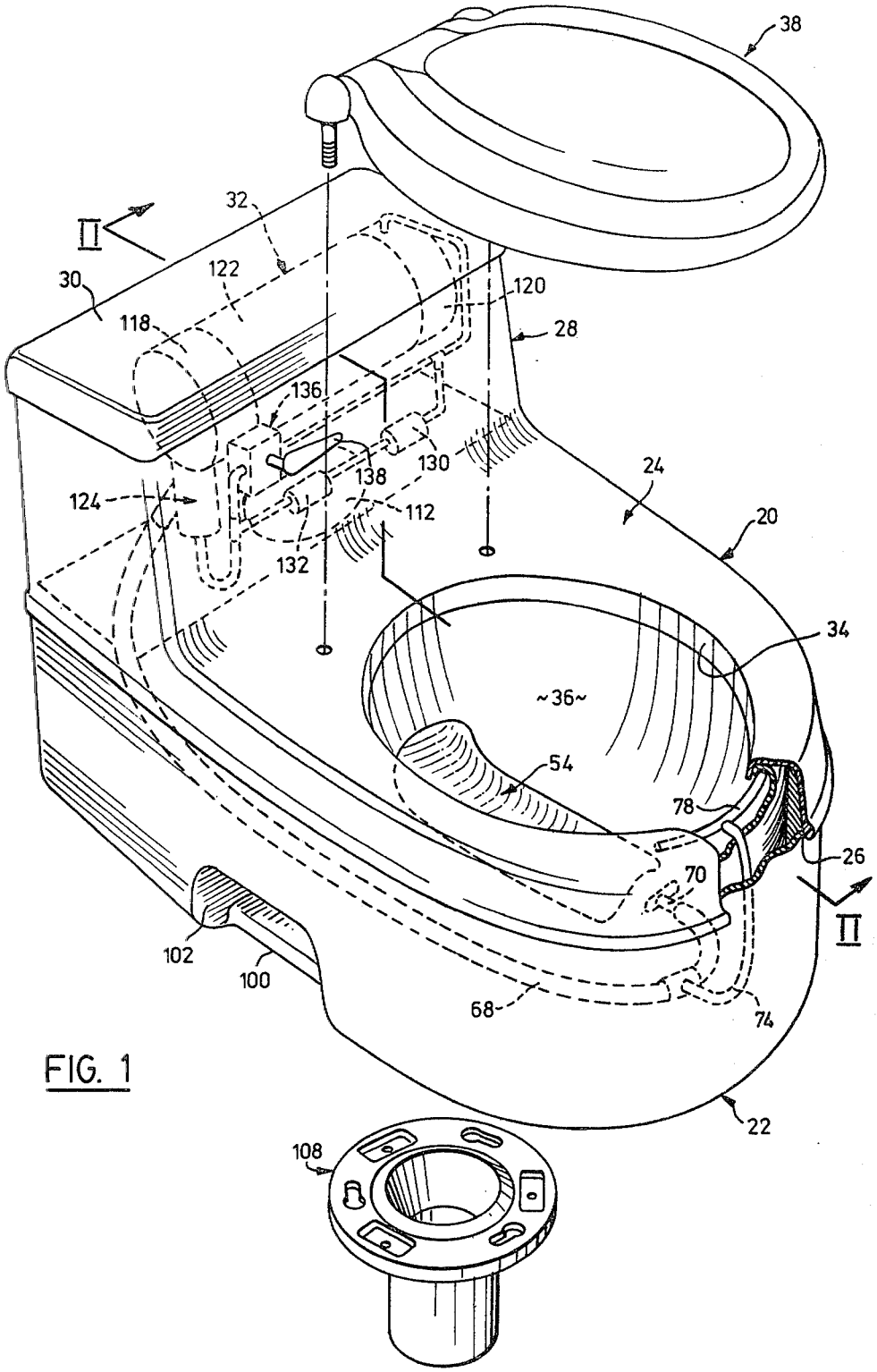
FIG. 1 is a perspective view, partly exploded, of a toilet according to a preferred embodiment of the invention.

Referring first to FIG. 1, the toilet has a housing generally denoted 20 made up of a lower housing part 22 and an upper housing part 24 which fit together at a joint line indicated at 26. The two housing parts are permanently sealed together by means of a suitable adhesive. Upper housing part 24 has an upwardly extending rear portion 28 which has a removable top 30 and which houses a holding tank 32 for flush water and associated components of the flush system as will be more specifically described later. Forwardly of portion 28, the upper housing part 24 is formed with a toilet bowl opening 34 providing communication to a bowl 36. A conventional toilet seat assembly, shown in an exploded position 38, is fitted to the upper housing part 24 so as to overlie the bowl opening 34.

Figure 2:
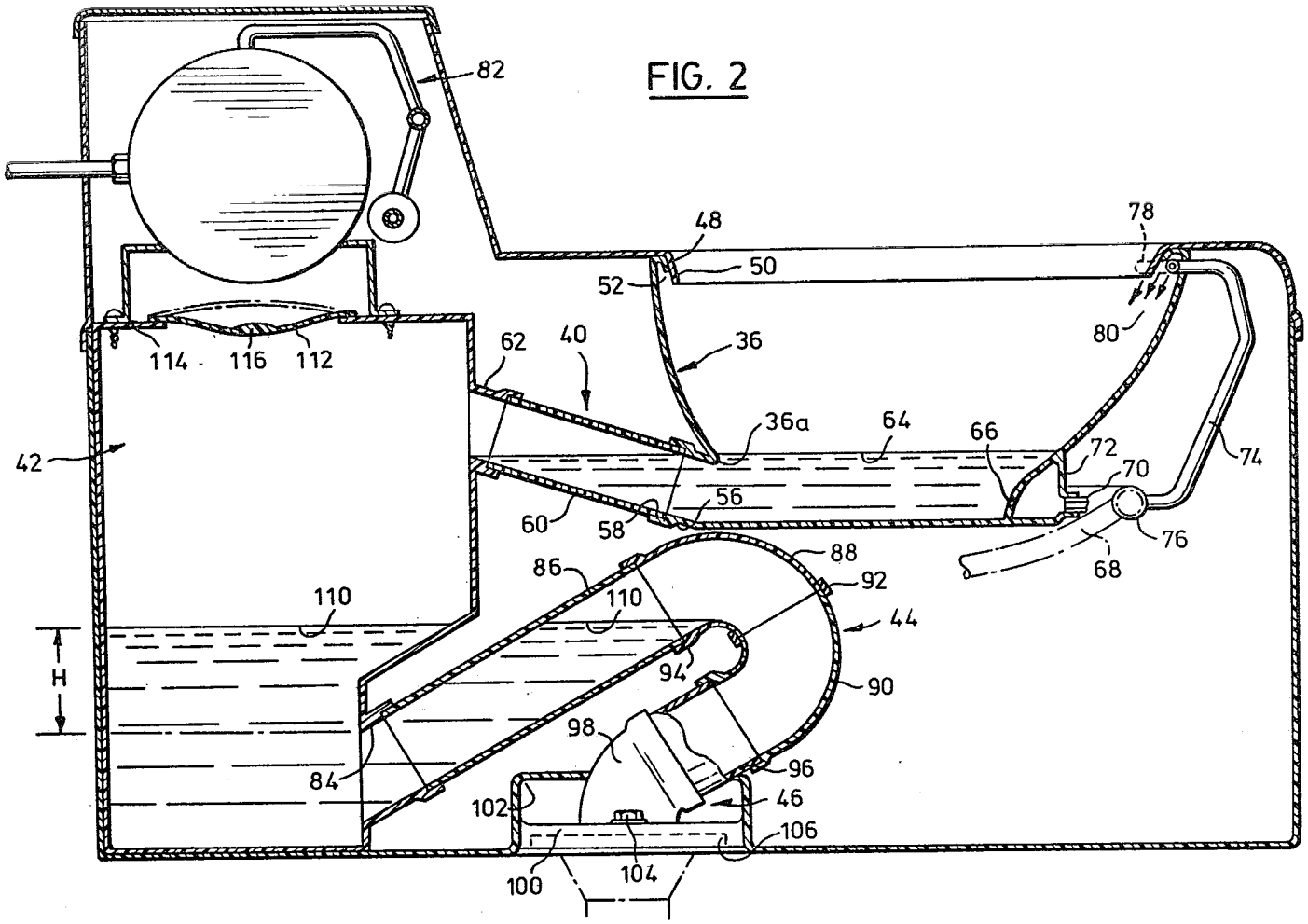
FIG. 2 is a longitudinal sectional view generally along line II—II of FIG. 1.

In FIG. 2, the toilet bowl 36 is visible in section and it will be seen that the bowl communicates with a waste outlet 40 which extends laterally from the bowl. Outlet 40 in turn communicates with a waste holding tank 42 which is disposed at the rear of the toilet housing, below the flush water tank 32. Adjacent its lower end, the holding tank communicates with an outlet 44, the outer end portion 46 of which is adapted to be connected to a sewer inlet generally in the manner of a conventional toilet.

Before describing the toilet in more detail, it may be convenient to note that, not only the housing 20, but also the remaining principal components of the toilet are, where possible, made of a suitable plastic material, eg. by vacuum forming, and are secured together by a suitable adhesive. Thus, the toilet bowl 36 is a vacuum plastic moulding having an inwardly turned lip 48 around its upper edge, which nests behind a downwardly directed flange 50 of the upper housing part 24 extending around the toilet bowl opening. Lip 48 is secured to the rear face of flange 50 by adhesive. It will be seen that the lip defines a recess 52, the purpose of which will be described later. At this point, it may be convenient to note that the toilet bowl and/or the upper housing part 24 will be provided with suitable supports for carrying the weight of a person seated on the toilet; however, for clarity of illustration, these supports have not been shown in the drawings.

As can best be seen in FIG. 1, the bottom of the toilet bowl is shaped to define a trough-shaped depression 54 which extends generally from front to back of the bowl.

At its rear end, depression 54 communicates with the bowl outlet 40 by way of a coupling 56 (FIG. 2) integrally formed on the bowl. The coupling 56 has an annular recess 58 in its outer end which receives an length of pipe 60 forming said waste outlet 40. A similar coupling 62 is formed on the waste holding tank and receives the opposite end of pipe 60. The pipe is secured into the tube couplings using a conventional solvent-type adhesive.

When the toilet is in use, a relatively shallow body of liquid will normally remain in the bottom of the bowl at a level indicated by reference numeral 64 in FIG. 2. This level will be determined by the angular inclination of the bowl outlet 40 and is chosen so that the outlet defines a first trap in which a relatively shallow body of liquid is normally retained for preventing gaseous communication through the trap. Thus, it will be seen that level 64 is always slightly above the portion 36*a* of the bowl at the top of outlet 40. This will prevent reverse flow of any unpleasant odours from the holding tank 42. At the same time, it is to be noted that this first trap formed by outlet 40 does not form the main sewer gas trap of the toilet and need not therefore be of substantial height. As a result, the volume of the residual body of liquid in the toilet bowl is relatively small and can be readily flushed from the bowl as will be described.

Flush water is delivered to the bowl through a series of openings in the wall of the bowl at the front end of the trough-shaped depression 54 referred to in connection with FIG. 1. One of these openings is visible at 66 in FIG. 2; the remaining openings are disposed in horizontal alignment with opening 66. Water is delivered to the opening 66 through a pipe 68 (see also FIG. 1) from the flush mechanism of the toilet (to be described). Pipe 68 is fitted over a spigot 70 (FIG. 2) which projects from a moulded housing 72 on the exterior surface of bowl 36. Housing 72 defines a chamber behind the opening 66 in which water delivered from the flush mechanism is distributed to the openings and issues into the bowl. It will be appreciated that the water leaving openings 66 will be directed towards the bowl outlet 40 and will accordingly tend to flush waste in the bowl directly into the outlet. The water is under pressure (as will be described) and has been found in practice to readily clear the bowl using a minimum volume flush. For example, in practical tests, a flush volume of 3 quarts (Imperial) has been found to be adequate over an extended period of time of ordinary domestic use of the toilet.

Rinsing of the toilet bowl is provided for by a rinse line 74 (FIG. 2) connected into the main flush water line 68 by a T-piece 76 (see also FIG. 1). Line 74 is connected to an arcuate shaped rinsing element 78 (see FIG. 1) which is secured by adhesive in the recess 52 behind the lip 48 of bowl. Element 78 is in the form of a length of pvc tubing closed at its ends and having a series of holes through which water can be directed downwardly over the surface of the bowl as indicated by the arrows 80 in FIG. 2. It is of course to be understood that, while only a short length of tubing has been shown in the drawings, in practice, the rinse element could extend over substantially the whole of the circumference of the toilet bowl.

With continued reference to FIG. 2, it will be remembered that the waste outlet 40 is connected to a coupling 62 on the holding tank 42 of the toilet. Tank 42 is a specially shaped plastic tank disposed inside the housing 20 of the toilet. The tank is of rectangular shape in plan and fills the entire width of the rear portion of the housing. The flush system of the toilet is generally indicated at 82 in FIG. 2 and, as can be seen, is mounted on the top of the tank.

Adjacent the bottom of its front wall, tank 42 includes an integral coupling 84 similar to the couplings 56 and 62 described previously. The holding tank outlet 44 extends outwardly from this coupling. As can be seen, outlet 44 is generally J-shaped and includes a straight pipe section 86 and two 90° elbows 88 and 90 joined to one another by a coupling sleeve 92 and joined to the outer end of pipe 86 by an integral coupling collar 94 on the inner end of elbow 88. At its outer end, elbow 90 is fitted with a short pipe section 96 which couples to a 45° elbow 98 fitting with an integral mounting plate 100 which extends transversely through a recess 102 in the toilet housing (see also FIG. 1). Plate 102 has openings for receiving securing bolts, one of which is indicated at 104, for securing the toilet to a floor surface. Plate 100 has a recess 106 in its under surface for receiving a flanged sewer inlet connection such as that indicated generally at 108 in FIG. 1. Thus, the portion of the toilet providing a connection to the sewer inlet is of the form conventionally used on domestic toilets in order that the toilet provided by the invention may be readily coupled to an existing sewer system in exactly the same fashion as a conventional toilet. The only other external connection required for the toilet will be the water inlet pipe, which will be a standard ½ inch or ¾ inch copper pipe as will be described.

The pipe 60 of the bowl outlet and the pipes 86 and 96 and the elbows 88 and 90 of the holding tank outlet 44 are all standard ABS plastic sewer pipe fittings and are secured in place using normal ABS solvent adhesive.

The holding tank outlet 44 defines a second trap of the toilet which is of substantial height compared with the height of the first trap defined by the bowl outlet. Thus, the static liquid level in the second trap is represented by the lines indicated at 110 in FIG. 2 and the trap height is represented by dimension 8 and provides the "legal" sewer trap height required by plumbing codes for preventing reverse flow of sewer gas into the toilet.

Holding tank 42 and the associated outlet 44 are dimensioned so that the volume of liquid contained therein in the static condition shown in FIG. 2 is substantially in excess of the volume of liquid discharged from the bowl at each flush. This avoids any possibility that a syphon effect might be set up which could tend to empty the second trap, as might occur if the holding tank were too small. Thus, the toilet is designed so that, when the bowl is flushed, the volume of liquid which passes into the holding tank will be sufficient to cause merely an overflow of liquid from the second trap into the sewer rather than a full scale flushing effect intended to generate a syphon as in the case of a conventional toilet.

For the same reason, the holding tank is fitted with a flexible diaphragm which extends across the tank above the level at which liquid enters from the bowl. This diaphragm is designed to flex upwardly to accommodate air displaced in the holding tank as liquid enters from the bowl. In this particular embodiment, the diaphragm is indicated at 112 and is in the form of a dome-shaped vaccuum moulded flexible sheet fitted across a circular opening in the top wall 114 of holding tank 42. The peripheral margin of the diaphragm is sealed in gas tight fashion to wall 114 by means of a suitable adhesive.

The diaphragm is shown in its normal static position in full line and in its position of maximum flex in chain dotted line. The diaphragm is designed so that the air displacement which can be accommodated by movement of the diaphragm from its full line position to its chain dotted line position exceeds the maximum anticipated volume of air which would be displaced when the toilet is in operation. Thus, in practice, it is likely that the diaphragm will probably not move fully to its chain dotted line position. The diaphragm is made of pvc and is sufficiently thin and flexible as to present minimal resistence to flexing. A relatively dense slug of adhesive is provided in the center region of the diaphragm as indicated at 116 in order to ensure that the diaphragm will naturally return to its full line position when all of the liquid and waste material from the bowl 36 has entered the holding tank 42.

Diaphragm 112 is important to the proper operation of the toilet in two respects. Firstly, it ensures that the air in holding tank 42 presents minimum resistence to flushing of liquid and waste from the toilet bowl into the holding tank. Were it not for the presence of the diaphragm the air in the holding tank would act as a buffer tending to resist inflow of liquid from the bowl. Thus, the diaphragm generally makes it easier to flush the bowl and allows less water to be used. Secondly, the diaphragm further reduces any likelihood of a syphon effect occurring at the second trap. Thus, if there were no diaphragm, the buffering effect of the air in the holding tank would tend to cause the liquid in the second trap to be pushed through the trap and might tend to promote a syphoning effect which could empty the trap. In contrast, the liquid which enters the holding tank from the bowl in the toilet being described, merely causes a gradual overflowing of liquid from the second trap, with no syphoning effect. Solid waste and tissue in the holding tank will tend to be broken down while standing in the holding tank and due to turbulence in the liquid (as a result of subsequent flushes, before passing into the sewer.

Figure 3:
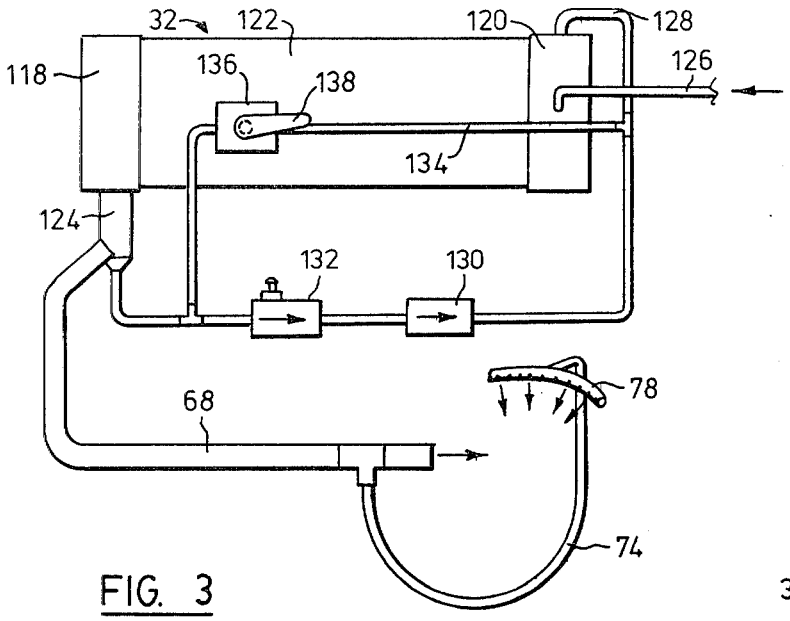
FIG. 3 is a schematic illustration of the flush system of the toilet of FIGS. 1 and 2.
Figure 4:
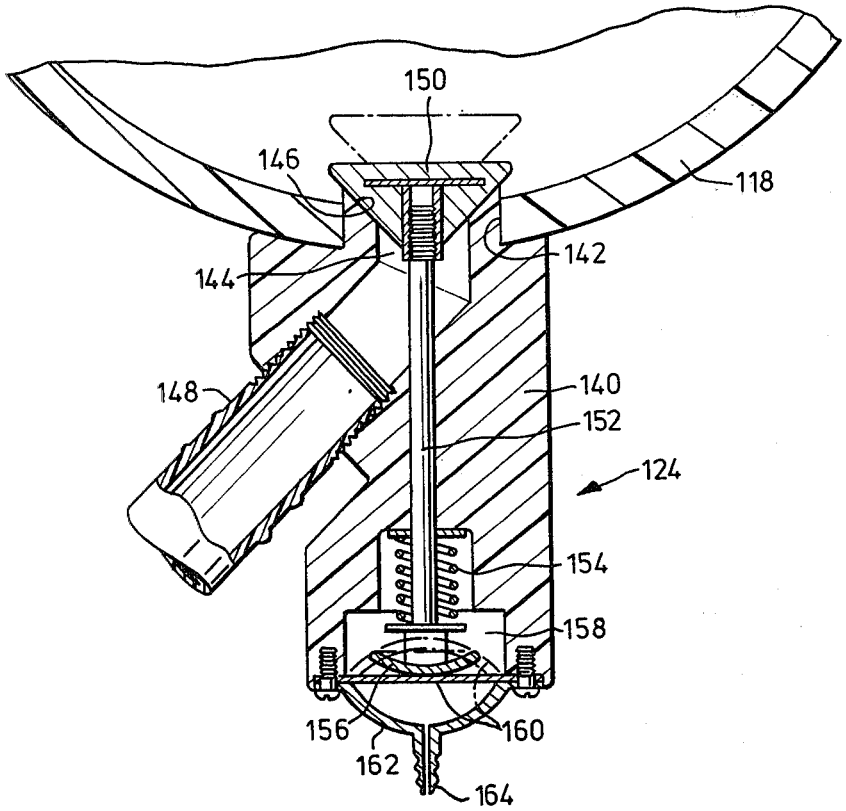
FIG. 4 is a detail view of part of the flush system.

Reference will now be made to FIGS. 3 and 4 in describing the flush system of the toilet. FIG. 3 shows the flush water tank 32 discussed previously. The tank is of generally cylindrical shape and comprises two end caps 118 and 120 fitted in air-tight fashion to a cylindrical body 122. End cap 118 is fitted with an air operated flush valve 124 which is shown in more detail in FIG. 4. End cap 120 is fitted with a coupling for a water inlet pipe 126 from the main water supply of the dwelling in which the toilet is installed. End cap 120 also has a tapping at the top for an air line 128. Air line 128 is connected to the flush valve 124 and includes a standard air check valve 130 and an adjustable flow control valve 122. A further air line 134 bypasses the valves 130 and 132 and is fitted with an on/off air valve 136 which is operated by a handle 138 in the manner of a conventional toilet flush handle. Handle 138 is visible at the front of the upper extension of the rear portion of the toilet housing in FIG. 1. Valve 136 is spring biassed to the "off" position in which it is shown.

Referring now to FIG. 4, the air operated flush valve 124 includes a body 140 having a cylindrical extension **140*a* at its inner end which is fitted into a opening 142 in the end cap 118 of cylinder 32. A water passageway 144 extends through extension 140*a* to the interior of cylinder 32 and is surrounded by a valve seat 146 inside the cylinder. Outside the cylinder, the passageway is fitted with a coupling 148 to which is attached the main water flush pipe 68 shown in FIGS. 1 and 2. A conical valve member 150 normally seats against valve seat 146 and is carried by a valve stem 152 which extends through valve body 140 and is fitted adjacent its outer end with a spring 154 arranged to normally bias valve member 150 against the seat 146. The outer end of valve stem 152 is fitted with an end cap 156 which is disposed in a recess 158 in the end of the valve body. A diaphragm 160 extends across the outer end of the recess and bears against cap 156. Finally, the diaphragm is surmounted by a dome-shaped cover 162 having a projecting spigot 164 to which is attached the air line 128 referred to in FIG. 3. Thus, it will be appreciated that, if pressurized air is delivered to valve 124 along line 128, the diaphragm 160 will bow inwardly as indicated in chain dotted line and will cause the valve stem 152 to move upwardly and lift the valve member 150 off its seat 146 and provide fluid communication between the interior of cylinder 32 and the flush water line 68**.

Referring back to FIG. 3, the sequence of operation of the flush mechanism will now be described. Assuming that cylinder 32 is initially empty, water will enter through line 126 and will begin to fill the cylinder. As the cylinder fills up (from the bottom) air will be trapped above the water and will be pressurized to an extent depending on the mains pressure of the water entering the cylinder. When the air above the water is fully pressurized, inflow of water will stop. Not only the air above the water will be pressurized but also the air in line 128 and in the portion of line 134 between line 128 and valve 136. Check valve 130 will prevent pressurized air from reaching the diaphragm of flush valve 124. If the flush handle 138 is now operated opening valve 136, the pressurized air in line 134 will be applied to the diaphragm 160 of the flush valve and the valve will open. The pressurized air in cylinder 32 will then eject the water under pressure through the main flush line 68. This pressurized water will be delivered directly to the front end of the trough-shaped depression 54 in the toilet bowl as described previously and will flush any waste in the toilet bowl into the holding tank also as described. At the same time, a rinsing action will occur in the bowl through rinse line 74. It will be noted that line 74 is of smaller diameter than the main flush line 68 so that a lesser volume of flush water will be used for rinsing than for the main flush action.

When the flush handle 138 is released, valve 136 will close, but the diaphragm 160 of flush valve 124 will be held in the pressurized position because the pressurized air will be trapped in line 134 due to the fact that 136 will be closed. However, flow control valve 132 will set to allow air to bleed back into the cylinder through line 128 so that the flush valve will close progressively. This will ensure that, rather than being abruptly cut off, the flow of flushing water will gradually diminish so as to ensure that a residual body of water will remain in the toilet bowl.

As soon as the flush water begins to leave cylinder 52 it will be replaced by water from line 126 so that the tank will immediately repressurize.

Figure 5:
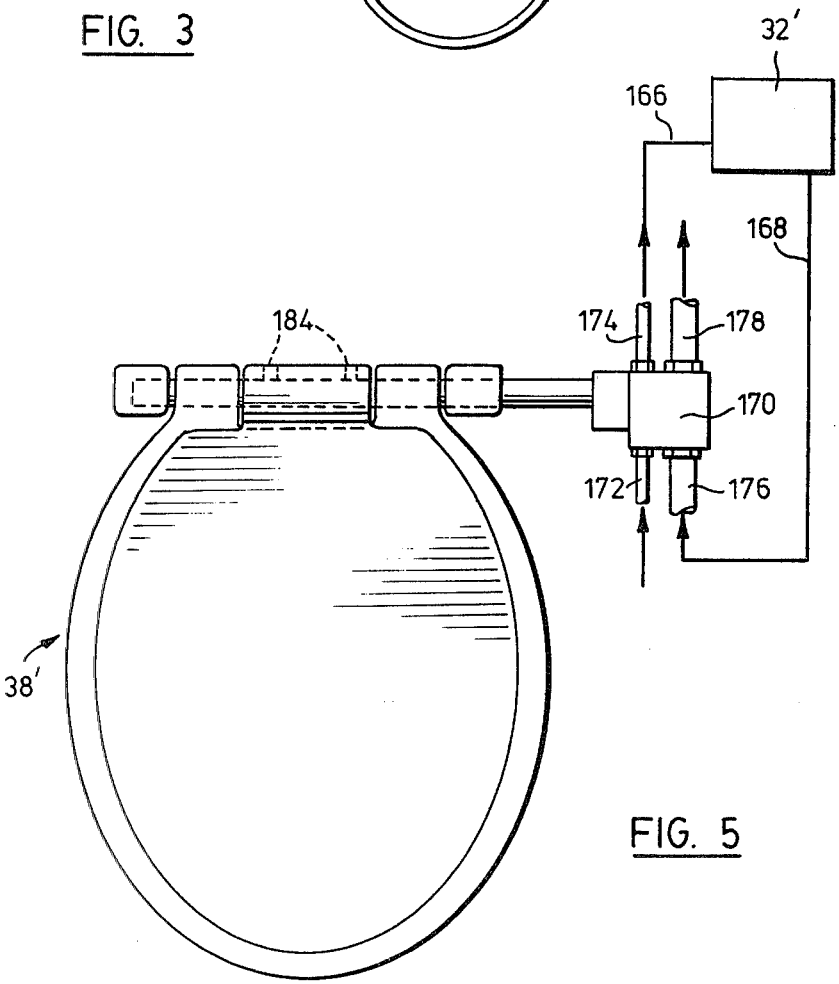
FIG. 5 is a plan view of an alternative flush actuating mechanism according to a further embodiment of the invention.

FIG. 5 illustrates an alternative mechanism for operating a pressurized water tank of the form described with reference to FIG. 3. Thus, in the FIG. 5 embodiment, the water tank would be essentially the same as tank 32 but with different connections; accordingly, the tank has been shown merely diagrammatically in FIG. 5 at 32'. The tank has a single inlet 166 for water and the single, larger diameter outlet 168. In this embodiment, the flush mechanism includes a seat-operated rotary valve 170 having an inlet 172 connected to a water supply and a corresponding outlet 174 connected to the cylinder inlet 166. The flush water outlet from cylinder 32' is connected to a second inlet 176 of valve 170 and a corresponding outlet 178 is connected to the main flush pipe 68 of the toilet.

Valve 170 is operated by a shaft 180 which is turnable in the valve housing to operate a valve member (not shown) for controlling communication between the inlets and outlets of the valve as will be described. Shaft 180 forms the hinge pin for the toilet seat assembly 38' of the toilet and is keyed to seat 182 of assembly 38' by lugs 184 which project from the shaft into corresponding recesses in the seat so that shaft 180 is turned by raising and lowering seat 182.

The valve member of valve 170 is designed so that, when the seat is in the down position in which it is shown, the water supply line 172 is closed while the flush line 176 is open and communicates with outlet 178 for delivering flushing water to the toilet. When the seat is raised, the connections are reversed so that the water supply inlet 172 is open allowing water to flow through the valve to tank 32' while the flush water inlet connection 176 of the valve is closed. Visualizing the toilet in use, it will be appreciated that, when the seat is raised by a person wishing to use the toilet, water will flow through valve 170 and into the tank 32', pressurizing the same ready for flushing. When the person has finished using the toilet and closes the seat the flush line from the tank will open and deliver flush water to the toilet bowl.

Reference will now be made to FIGS. 6 to 15 in describing further embodiments of the invention. Double primed reference numerals have been used in those views to denote parts which correspond with parts shown in the previous views.

Figure 6:
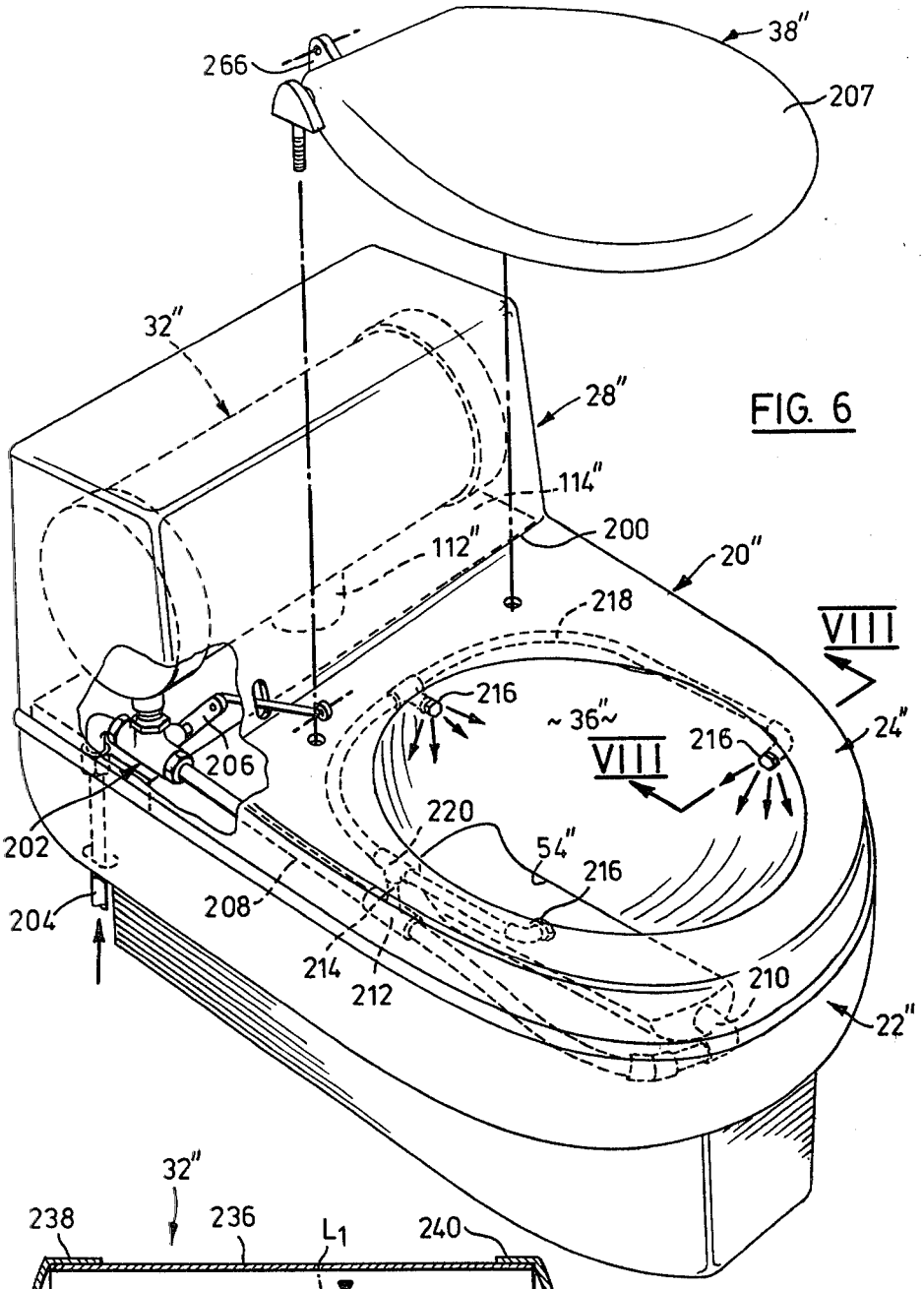
FIG. 6 is a view similar to FIG. 1 showing a toilet according to a further preferred embodiment.

Referring first to FIG. 6, the toilet shown in that view includes a housing 20" which is essentially very similar to the housing shown in FIGS. 1 and 2 although of somewhat different style. Thus, the housing includes a lower housing part 22", and an upper housing part 24" defining an upwardly extending rear portion 28". In contrast to FIGS. 1 and 2, the rear portion 28" does not have a lid but is designed to be removable as a whole. A joint line between portion 28" and the remainder of the upper housing part is visible at 200. With the exception of portion 28", the two housing parts are permanently secured together.

The toilet has a bowl 36" which is moulded integrally with the relevant portion of the upper housing part 24". The bowl has a trough shaped depression 54" which communicates through a shallow trap with a waste holding tank at the rear of the toilet in substantially the same manner as disclosed with reference to FIGS. 1 and 2. The top wall of the holding tank is visible at 114" and the diaphragm in that wall is indicated at 112". The holding tank is of generally the same form as the tank 42 shown in FIG. 2 and communicates with a second trap as shown in that view.

A flush water holding tank 32" is disposed inside the cover portion 28" of the toilet upper part. A flush valve 202 is associated with the tank and controls both admission of water to the tank and flushing of the toilet. A water inlet line connected to the valve is indicated at 204 and a valve operating lever is shown at 206. Lever 206 is coupled to a lid 207 of the toilet so that the valve is operated automatically in response to raising and lowering of the toilet seat as will be described later. A flush water discharge line 208 extends outwardly from valve 202 and is connected to a main flush water discharge nozzle 210 at the forward end of the toilet bowl depression 54". A T-piece 212 is connected in line 208 and has a lateral connection 214 to a bowl rinse jet system. Connection 214 is of smaller diameter than line 208 so that the volume of water which flows to the rinse jet system will be less than the volume of the main flush. The rinse jet system includes three jets 216 which extend through the wall of the toilet bowl just below its rim at positions spaced around said rim, and a length of tubing 218 to which the jets 216 are coupled and which is itself coupled to the lateral connection 214 of T-piece 212 by a further T-piece 220. Thus, when the toilet is flushed, the rinse jets 216 will receive a volume of water smaller than the main flush for the purpose of rinsing the bowl. One of the rinse jets 216 is shown individually in FIG. 8 and includes a valve body 222 disposed at the inner surface of the toilet bowl wall, and having a water discharge passageway 224 which is screw threaded at its outer end and into which is screwed a spray head 226. Referring back to FIG. 6, it will be seen that the two endmost rinse jets 216 have valve bodies of elbow shape while the third rinse jet has a T-shaped valve body. In either event, the water discharge passageway 224 has a inlet end which communicates with the tube 218 of the rinse system for delivering water to the spray head 226.

Spray head 226 has a generally cylindrical shaped body 228 with a hexagonal portion 230 at its outer end by which the head can be turned using a wrench. Body 228 is externally screw threaded at its outer end and is screwed into the passageway 224 in body 222. Immediately behind the hexagonal portion 230 of the spray head is a transversely extending water discharge slot 232 which extends over approximately half of the diameter of body 228. A water outlet passageway 234 extends through body 228 and includes a relatively large diameter portion at the outer end of the body which merges into a narrow portion disposed generally axially of body 228 and communicating with slot 232. Thus, water delivered to the valve body along tube 218 will be discharged into slot 232 and will issue downwardly from the spray head 226 in a fan-like spray pattern over the inner surface of the toilet bowl. It will be noted that the face of slot 232 against which the water will impinge is curved to facilitate smooth downward flow of the water.

Figure 7:
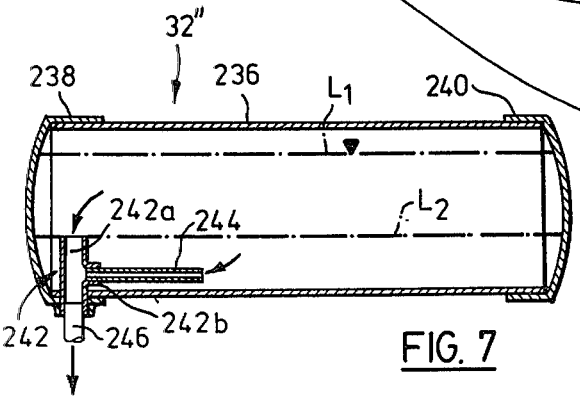
FIG. 7 is a vertical sectional view through the tank of the toilet shown in FIG. 6.
Figure 8:
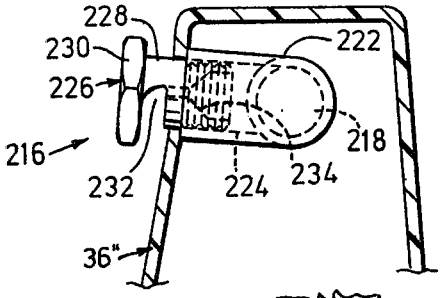
FIG. 8 is a sectional view on line VIII—VIII of FIG. 7.

FIG. 7 illustrates the flush water tank 32" used in the toilet shown in FIG. 6. The tank has a cylindrical body 236 fitted with airtight end caps 238 and 240. Tank 32" is a pressure tank and is designed to operate in generally similar fashion to the tank 32 shown in the previous views in that the pressure of incoming water is used to compress the air in the tank and the pressurized air is then used to expell the water for flushing. However, in this case, the tank includes a water inlet/outlet fitment 242 designed to provide an automatic "topping up" action to ensure that a residual amount of water always remains in the trap in the toilet bowl. Fitment 242 is fitted inside the tank in an opening in the bottom of the tank which extends through the wall 236 and through a portion of end cap 238. The fitment is generally T-shaped and includes a large diameter passageway **242*a* which is disposed generally vertical as seen in FIG. 7 (radially of body 236) and a lateral port 242*b* which is of smaller diameter than and communicates with passageway 242*a*. A drain tube 244 is fitted inside port 242*b* and extends generally horizontally (axially of body 236). The lower end portion of passageway 242***a* receives a pipe 246 communicating with the flush valve 202 (FIG. 6).

Valve 202 will be described in more detail later. For present purposes, it is sufficient to note that, during filling of the tank, valve 202 allows water to enter fitment 242 through pipe 246. Most of this water will flow upwardly through passageway 242*a* and into the interior of the tank. The water level in the tank will rise, compressing the air above the water until the pressure of the air balances the pressure of the incoming water. At this time, the water may typically be at the level indicated by line $L_1$ in FIG. 7. The interior of the tank will remain exposed to the incoming water pressure until valve 202 is operated to flush the toilet. At that time, pipe 246 will be placed in communication with the flush pipe 208 (FIG. 6) and the water will flow from the tank into pipe 208 under the pressure of the contained air. Most of the water will flow through passageway 242*a* at a relatively high rate. When the water level has dropped to approximately the position indicated by line $L_2$, flow through the main passageway 242*a* will cease and the main part of the flush cycle will come to an end. However, water will continue to drain into fitment 242 through tube 244 and port 242*b*. Due to the smaller diameter of port 242*b*, the water flow rate from the tank will be much less than during the main part of the flush cycle. Also, as soon as the water level drops below the top of fitment 242, air will be allowed to enter the tank through passageway 242*a* and the interior of the tank will be at atmospheric pressure. Accordingly, the remaining water will flow out under gravity only and will therefore flow at a much slower rate than the main portion of the flush under pressure.

The relative diameters of passageway 242*a* and port 242*b*, the height of fitment 242 and the vertical position of port 242*b* will all be selected to provide appropriate flow characteristics according to the particular toilet in question. For example, it is of course important that the flow volume and duration of the main portion of the flush should be sufficient to ensure complete flushing of the contents of the bowl.

Figure 9:
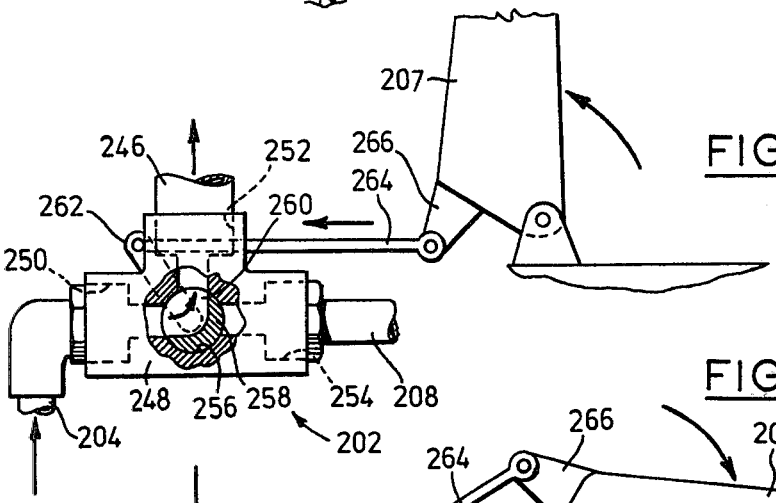
FIGS. 9 and 10 are detail elevational views of the flush valve and its operating mechanism of the toilet of FIG. 6.
Figure 10:
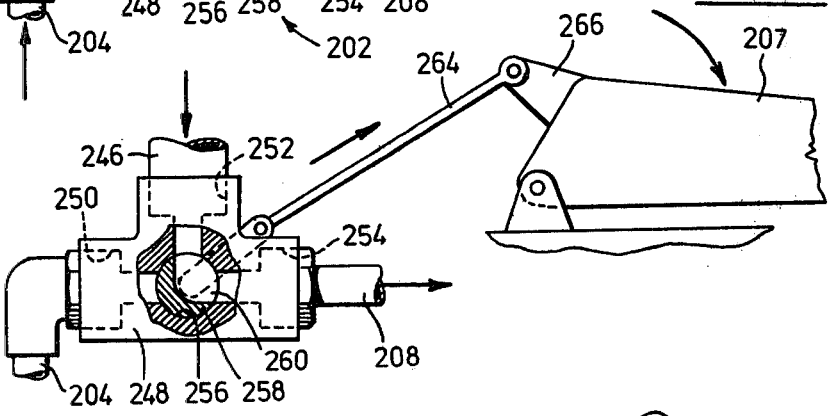
Figure 11:
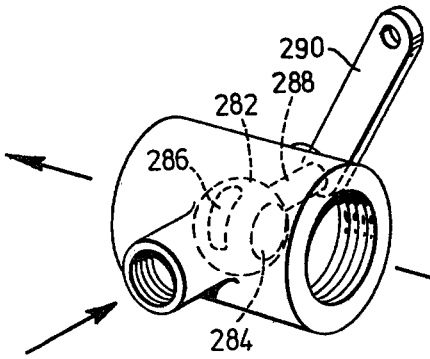
FIG. 11 is a detail perspective view of the valve of FIGS. 9 and 10.
Figure 12:
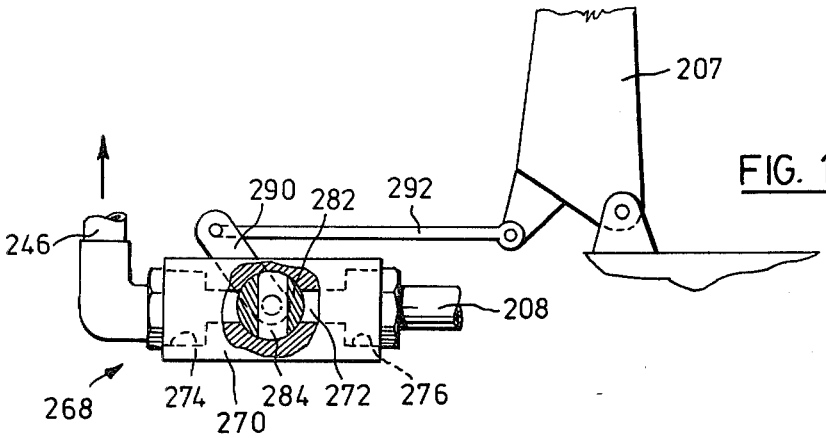
FIG. 12 is a view similar to FIG. 9 showing an alternative form of flush valve, the valve being shown in the "fill" position.
Figure 13:
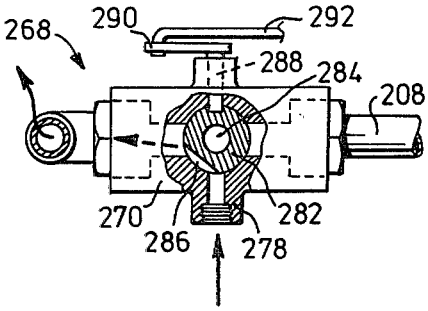
FIG. 13 is a plan view corresponding to FIG. 12.

Reference will now be made to FIGS. 9 and 10 in describing the flush valve 202 in more detail. The valve has a body 248 formed with three interally screw threaded ports 250, 252, and 254. The ports communicate with corresponding passageways which lead to a valve chamber 256 having a cylindrical valve member 258. A recess is formed in the curved surface of member 258 to define an angled valve passageway 260 and the valve member is turnable about its axis through 90° to bring passageway 260 into either of two positions. In a first position, passageway 260 provides communication between valve port 250 and port 252, and in a second position ports 252 and 254 will be in communication. The valve member is mounted on a shaft which protrudes from body 248 and to which a lever 262 is attached for operating the valve.

Valve port 250 communicates with the main water inlet line 204 (FIG. 6) while port 252 communicates with the pipe 246 connected to the flush tank fitment 242. The third port 254 communicates with the main flush line 208.

FIG. 9 shows valve 202 in the "fill" position in which the valve member 258 allows communication between the water inlet portion 250 and the port 252 connected to the flush water tank. In this position, water flows into the tank until its internal air pressure reaches the pressure of the incoming water. When the toilet is to be flushed, valve member 258 is turned so that the interior of the tank now communicates with the flush line 208. The water inlet line 204 is at this time blocked by the valve member and the water in the tank is discharged into line 208 as described in connection with FIG. 7. Thus, the main charge of flush water will be delivered into the bowl of the toilet under pressure and the top up water will flow through the valve and into the toilet. This is the normal rest position of the valve and is shown in FIG. 10.

In this particular embodiment, valve 202 is operated automatically by raising and lowering the toilet seat. Thus, the valve operating link 264 is pivotally connected at one end to the outer end of the valve operating lever 262 and extends forwardly through the toilet housing as shown in FIG. 6. At its outer end, link 264 is pivoted to an integral lug 266 which projects rearwardly from the toilet lid 207. It will be appreciated from a comparison of FIGS. 9 and 10 that the various components are positioned so that, when the toilet seat is down (its normal position) the valve member 258 will be in the position shown in FIG. 10 and with the seat up the valve member will adopt its FIG. 9 position. Assuming the toilet has been flushed and the seat is normally in its down position, the flush water tank 32" will remain empty with the interior of the tank in communication with atmosphere through the main flush line 208 and the rinse jets 216. When the toilet is to be used, the seat lid will be raised, causing valve member 258 to turn so that the tank will fill from inlet line 204. When the user subsequently closes the seat lid, the valve member will be returned to the position shown in FIG. 10 and the contents of the tank will flush into the bowl and top up the shallow trap as discussed previously.

Figure 14:
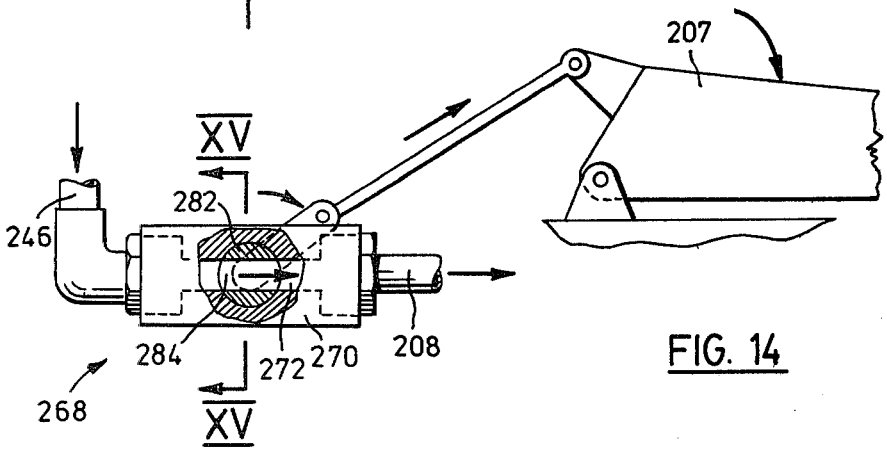
FIG. 14 is a view similar to FIG. 12 showing the valve in the "flush" position; and, FIG. 15 is a sectional view on line XV—XV of FIG. 14.

FIGS. 11 to 15 illustrate an alternative form of flush valve which may be used in place of valve 202. This valve is generally indicated at 268 and includes a valve body 270 having a straight through passageway 272 of relatively large diameter communicating at one end with a port 274 for connection to the tank 32" of the toilet, and at its opposite end with a port 276 for connection to the bowl of the toilet by way of flush line 208. The valve body also has a lateral port 278 (FIG. 13) for connection to the water inlet line 204 of the toilet. The three ports communicate with a valve chamber 280 which houses a valve member 282 of generally spherical shape having a diametrally extending passageway of a relatively large diameter substantially equal to the diameter of the passageway 272 in the valve body. The shape of the valve member can best been seen in FIG. 11 and the passageway is indicated at 284. The valve member is turnable about an axis generally normal to passageway 284 so that the valve member can be moved through 90° from the position shown in which passageway 284 communicates with the passageway 272 in the valve body and allows water to flow straight through the valve body from the tank to the bowl during flushing (as shown in FIG. 14), to a position in which the passageway 284 is disposed generally normal to passageway 272 (see FIGS. 12 and 13). In this latter position, there is no communication between the tank and bowl but the water inlet port 278 communicates with the tank port 274 by way of a recess 286 in the exterior surface of the valve member (see FIGS. 11 and 13). It will be seen that the recess is positioned and dimensioned to allow water to "bleed" past the valve member 282 from the water inlet port 278 to the tank port 274 for filling of the tank.

The advantage of the form of valve shown in FIGS. 11 to 15 is that the valve provides a relatively large diameter "straight through" flow passageway between the tank and bowl for flushing of the toilet; there is no restriction or diversion of the flush water within the valve body which would otherwise cause some of the energy flush water to be lost. Inevitably, this valve configuration leads to some restriction in the passageway between the water inlet line and the tank (recess 286) but this is found to be relatively unimportant to the satisfactory operation of the toilet in that there is normally an adequate length of time for the tank to fill completely even through a restricted passageway such as that represented by recess 286.

Figure 15:
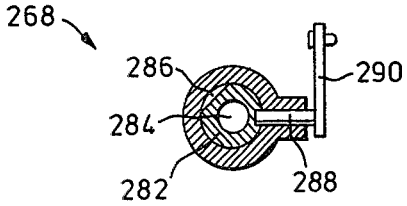

The valve member 282 is carried by a turnable axle 288 disposed on the turning axis of the valve member and the axle has a lever 290 at its outer end which is coupled to the toilet lid by a link 292 in much the same fashion as link 264 in the previous embodiment. FIG. 15 in particular shows the axle 288 and lever 290. This view also illustrates that the recess 286 is of no effect when the valve member is in the position in which water flows straight through from the tank to the bowl.

Although the valve 268 has been described in association with the particular form of toilet provided by the present invention, it is to be understood that the valve may also be useful in other forms of toilets.

It will also be appreciated that the preceeding description relates to specific embodiments of the invention only and that many modifications are possible within the broad scope of the invention. For example, while a number of specific flush systems have been described, other alternatives are possible. Preferably, the flush water is pressurized to achieve a high pressure action. However, it might even be possible to flush the toilet using a conventional water tank and gravity feed flush system. Another possibility would be to use a two tank flush system in which the two tanks would alternately fill and be used for flushing so that one tank would always contain water under pressure and would be ready to be used instantly when a flush was required.

Referring to the holding tank of the toilet (e.g item 42 in FIG. 2), the diaphragm (112) need not be mounted in the top wall of the tank as described. It could, for example, extend across the tank below the top wall. It would even be possible to mount the diaphragm in a vertical wall of the tank although in that event special means would have to be provided to return the diaphragm to its rest position. Also, it should be noted that, while the specific description refers to a toilet constructed primarily of plastic moulded components, there is no limitation in this. Conventional ceramic manufacturing techniques could be applied to the toilet provided by the invention.

We claim:

1. A toilet which includes:

a bowl for receiving waste;

a waste outlet extending laterally from the bowl and defining a first, shallow trap arranged so that a relatively shallow body of liquid is normally retained in the bowl for preventing gaseous communication through the trap;

a flush system arranged, when operated, to deliver a charge of flushing liquid into the bowl in a direction to cause said body of liquid and waste to be discharged through said outlet;

a waste holding tank communicating with said bowl outlet for receiving waste from said bowl;

a holding tank outlet extending outwardly from said tank and adapted for connection to a sewer inlet, said holding tank outlet defining a second trap of substantial height capable of preventing reverse flow of sewer gas into the holding tank in use;

the holding tank and second trap being arranged to contain a volume of liquid substantially in excess of that discharged from the bowl at each flush; and, a flexible diaphragm extending across the holding tank above the level at which liquid enters from the bowl and sealed to the tank in gas-tight fashion, said diaphragm being adapted to flex upwardly and accommodate air displaced as liquid enters the tank from the bowl, so as to minimize air resistance to flushing of liquid from the bowl.

2. A toilet as claimed in claim 1, wherein the bowl has a trough-shaped depression extending generally from front to rear of the bowl, wherein said outlet is disposed at the rear end of said depression, and wherein the flush system is arranged to deliver flush liquid into the bowl at the front end of said depression in a direction towards said outlet.

3. A toilet as claimed in claim 1 or 2, wherein the waste outlet from the bowl is defined by a inclined pipe extending upwardly from an outlet opening in the bowl to an inlet opening in the holding tank and arranged at an inclination such that the portion of the bowl defining the top of said opening is maintained below the level of said relatively shallow body of liquid in the bowl.

4. A toilet as claimed in claim 1, wherein said flexible diaphragm is provided in a top wall of the holding tank, and wherein the diaphragm is weighted so that it normally assumes a depressed position in the tank.

5. A toilet as claimed in claim 1, wherein said flush system includes a main flush pipe connected to said bowl and a bowl rinsing pipe which is of smaller diameter than said main flush pipe and which is arranged to deliver flush liquid to a position adjacent the upper edge of the bowl for rinsing the bowl surface.

6. A toilet as claimed in claim 1, wherein said flush system includes a closed water tank; means for delivering water to said tank under pressure directly from a main supply, whereby air trapped in the tank is pressurized by incoming water; valve means operable by a person using the toilet for releasing the pressurized water from the tank; and conduit means for delivering pressured water from the tank to the bowl for flushing.

7. A toilet as claimed in claim 6, wherein said valve means is an on/off air valve biased towards its off position, and wherein the flush system further comprises: an air operated flush valve which is normally closed and is adapted to open under the influence of air pressure to release flush liquid to the bowl; a first air line coupling said air operated flush valve through said on/off air valve with pressurized air trapped in the tank; and a second air line bypassing said on/off valve and arranged to allow pressurized air applied to said flush valve to bleed back to the tank when the on/off valve is closed, whereby the flow of flush liquid to the bowl is progressively terminated.

8. A toilet as claimed in claim 7, wherein said second air line includes an adjustable flow control valve for varying the speed of bleed back of air to the tank.

9. A toilet as claimed in claim 6, wherein said valve means is coupled to a seat of the toilet and is operable to allow water to flow into the tank when the seat is up and to flow from the tank for flushing the toilet when the seat is closed.

10. In a toilet having a bowl for receiving waste and a flush system for delivering flush liquid to the bowl, the improvement comprising:

a waste outlet extending laterally from the bowl and defining a first, shallow trap arranged so that a relatively shallow body of liquid is normally retained in the bowl for preventing gaseous communication through the trap;

a waste holding tank communicating with said bowl outlet for receiving waste from said bowl;

a holding tank outlet extending outwardly from said tank and adapted for connection to a sewer inlet, said holding tank outlet defining a second trap of substantial height capable of preventing reverse flow of sewer gas into the holding tank in use;

the holding tank and second trap being arranged to contain a volume of liquid substantially in excess of the liquid volume discharged from the bowl at each flush; and, a flexible diaphragm extending across the holding tank above the level at which liquid enters from the bowl and sealed to the tank in gas-tight fashion, said diaphragm being adapted to flex upwardly to accommodate air displaced as liquid enters the tank from the bowl.

11. A toilet as claimed in claim 1, wherein said flush system includes: a closed pressure tank for flush water having a single opening in a lower region of the tank; an inlet/outlet fitment disposed in said opening and defining a main generally upright water passageway of relatively large diameter extending into the tank and having an open inner end, and an open lateral port of substantially smaller diameter than said passageway spaced vertically by a predetermined distance from said open upper end and communicating with said passageway; valve means disposed externally of said tank and coupled to said fitment for controlling water flow through said passageway, said valve means additionally being adapted to be coupled to a source of water under pressure; and conduit means for delivering water from the tank to the bowl for flushing; said valve means including a valve member movable by a user of the toilet between a first position permitting water under pressure to be delivered from said source into the tank in use so that air trapped in the tank is pressurized by the incoming water, and a second position in which said passageway is placed in communication with said conduit means whereby water in the tank will be delivered by said pressurized air through said passageway and said conduit means into the bowl until the water level in the tank reaches the position of said passageway open upper end, following which the water will drain at a slower rate by gravity by way of said port for topping up of said first trap in the toilet.

12. A toilet as claimed in claim 11, wherein said valve means includes a valve body having a straight through water flow passageway extending from a first position in said valve body communicating with said tank fitment to a second port in said body communicating with said conduit means, a valve chamber interposed between said ports in said passageway and receiving a valve member having an opening forming part of said passageway, said valve member in its said second position providing communication between said first and second port by way of said opening, a third port in said valve body communicating with said valve chamber and adapted to be coupled to said source of water under pressure, said valve member further including a recess in its outer surface providing communication between said first and third ports when the valve member is in its first position for filling of said tank with water.

13. A toilet as claimed in claim 11 further comprising a lid for said toilet bowl, said lid being movable between a closed position and an open position, and means coupling said lid with said valve member so that the valve member is in its said first position when the toilet lid is open and is in its said second position when the toilet is closed.

14. A toilet as claimed in claim 11, wherein said conduit means includes a main flush pipe extending between said valve means and said bowl and arranged to deliver said charge of flushing liquid into the bowl, and a bowl rinsing system including a pipe of smaller diameter than said main flush pipe and connected to said pipe so that a portion of said flush water flows into said flush system, and a plurality of rinse jets disposed in said bowl adjacent said upper edge thereof and coupled to said tube for delivering rinsing water onto the inner surface of the bowl.

* * * * *